US009976110B2

(12) United States Patent
Bartelt-Kelly

(10) Patent No.: US 9,976,110 B2
(45) Date of Patent: May 22, 2018

(54) COSMETIC BRUSH SOAP

(71) Applicant: Christina Bartelt-Kelly, Schwenksville, PA (US)

(72) Inventor: Christina Bartelt-Kelly, Schwenksville, PA (US)

( * ) Notice: Subject to any disclaimer, the term of this patent is extended or adjusted under 35 U.S.C. 154(b) by 239 days.

(21) Appl. No.: 14/831,612

(22) Filed: Aug. 20, 2015

(65) Prior Publication Data

US 2016/0053208 A1 Feb. 25, 2016

Related U.S. Application Data

(60) Provisional application No. 62/039,943, filed on Aug. 21, 2014.

(51) Int. Cl.

| | |
|---|---|
| ***C11D 9/38*** | (2006.01) |
| ***C11D 9/44*** | (2006.01) |
| ***C11D 13/16*** | (2006.01) |

(52) U.S. Cl.

CPC ..... *C11D 9/38* (2013.01); *C11D 9/442* (2013.01); *C11D 13/16* (2013.01)

(58) Field of Classification Search

None

See application file for complete search history.

(56) References Cited

U.S. PATENT DOCUMENTS

2010/0285713 A1* 11/2010 Somerville Roberts ..... C11D 3/0015 442/96

2011/0232681 A1 9/2011 Hatfield

OTHER PUBLICATIONS http://www.londonbrushcompany.com/products/brush-shampoo-english-lavender.
http://www.cleanbrushes.com/lemon-goats-milk/.
http://www.soapplace.com/images/fb/pdf/goats.pdf.
http://www.tigi-cosmetics.com/face/foundation/satin-liquid-foundation/.
http://www.qosmedix.com/pages/product/89/30331/Round-Blending-Brush.aspx.
http://www.londonbrushcompany.com/products/brush-shampoo-naturally-clean.
https://www.love-makeup.co.uk/clean-grapefruit-goat-milk-brush-shampoo-p-6155.html.
http://www.enkoremakeuponline.com/BSoapOriginal.html.

* cited by examiner

*Primary Examiner* — Necholus Ogden, Jr.
(74) *Attorney, Agent, or Firm* — Cozen O'Connor

(57) ABSTRACT

A cosmetic brush cleanser having a solid goat's milk soap base and comprising almond oil, jasmine oil, coconut oil, and lavender oil.

18 Claims, No Drawings

COSMETIC BRUSH SOAP

This application claims priority from U.S. Provisional Application Ser. No. 62/039,943, filed Aug. 21, 2014, the content of which is hereby incorporated by reference in its entirety.

FIELD OF INVENTION

The present application is generally related cosmetic cleaners and soaps, for cleaning of brushes and instruments utilized in applying makeup, wherein the soap and cleaners utilized contain anti-microbial, anti-fungal, and anti-bacterial properties within the cleansing material.

BACKGROUND OF THE INVENTION

In the cosmetic industry, there is a need to continually clean and maintain the tools used by individuals and beauticians alike. Common tools for the application of cosmetic supplies, such as various concealers, skin conditioners, lotions, powders, perfumes, lipsticks, polishes, blush, foundation, glosses, liners, lip plumpers, lip balms, primers, conditioners, and other materials that may be applied to the face or body of a person, are frequently applied with various brushes. These various beauty supplies have different characteristics and repel water, or other detergents at varying efficiencies. Thus, removal of the cosmetic supplies from an applicator or brush may be difficult in some circumstances.

Of course, removal of one cosmetic supply, for example, a certain color powder, so that a different color powder can be applied is often necessary for proper application of the various beauty supplies. Furthermore, applications between different users require that the brushes and other tools are cleaned appropriately to prevent spread of germs between users.

One of the most important aspects of cleaning a brush is the removal and cleansing of bacteria and or viruses that come into contact with the brush. For example, a brush used on the eye can transmit pink eye, or other eye infections. Brushes used on the lips, can easily spread germs such as herpes. There are numerous stories of consumers falling ill after make-up application only to find that a soiled brush was the culprit.

Even individual users benefit from removal of oil, bacteria, germs, and viruses from their brushes, as spreading these germs, even on a user's own face, eyes, or lips can extend cold sores, introduce bacteria to ones eye, spread germs and bacteria that cause acne, and other issues that can be prevented by cleaning cosmetic brushes.

Several products are currently on the market to clean cosmetic brushes. For example, US 2011/0232681 comprises an emollient, an oil remover, a disinfecting agent, a cleaning agent, and a fragrance. However, the product has a slow drying time, requires substantial amount of the product to clean the brushes, and results in damage to the brushes because it does not both clean and protect the brush.

Another product by London Brush Company is a lavender brush shampoo. However, it too, like the prior example does not fully clean the brushes without significant product, is slow to dry, and does not have a conditioner incorporated into the cleanser.

Finally, cleanbrushes.com has a lemon-goats-milk product that again fails to provide for a cleanser that dries quickly, cleans the brush, protects the brush bristles, and perform these functions with an efficient amount of product.

SUMMARY OF THE INVENTION

An embodiment of the invention comprises a new and improved cosmetic brush cleanser comprising: a soap base and a combination of essential oils comprising almond, jasmine, coconut, and lavender.

A further embodiment is a cosmetic brush cleanser comprising a soap base, almond oil, jasmine oil, and lavender, wherein said soap base is combined with said mixture of essential oils at a percentage of about 2.5% to about 9.7% based on soap base.

A further embodiment is a cosmetic brush cleanser comprising a soap base, and four essential oils, wherein said soap base is combined with said mixture of essential oils at a wt:wt ratio of about 50:1.25 to about 50:2.7.

A further embodiment is directed to a process for making a cosmetic brush cleanser comprising melting a sufficient quantity of solid soap base, and thereafter adding to the melted soap base a sufficient quantity of a mixture of essential oils; stirring the essential oils into the melted soap base; and pouring the resulting composition into a receptacle and allowing the resulting composition to solidify.

A further embodiment is directed to a method of cleansing a cosmetic brush comprising: adding a suitable amount of a cosmetic brush cleanser to the cosmetic brush, wherein the cosmetic brush cleanser comprises a soap base and a mixture of at least four essential oils admixed into the soap base; rinsing the cosmetic brush cleanser from the cosmetic brush; and allowing said cosmetic brush to dry.

A further embodiment is directed to a cosmetic brush cleaner comprising a goat's milk soap base and a combination of at least four oils, wherein the goat's milk soap base comprises about 95 to about 97.5% and the combination of at least four oils comprises between about 2.5% to about 5% of the total weight of the cosmetic brush cleaner.

DETAILED DESCRIPTION OF THE EMBODIMENTS

The embodiments of the invention and the various features and advantages thereto are more fully explained with references to the non-limiting embodiments and examples that are described and set forth in the following descriptions of those examples. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the claims.

As used herein, terms such as "a," "an," and "the" include singular and plural referents unless the context clearly demands otherwise.

As used herein, the term "about" means within 10% of a stated number.

All patents and publications cited herein are incorporated by reference in their entirety.

A cosmetic brush cleanser must cleanse the brush and remove oils, pigments, as well as other components of the cosmetic product that is on the brush. The components that make up a preferred embodiment include a soap base, a conditioner, a fragrance, and an antiseptic additive. Typically, the cosmetic brush cleanser is a mixture of soap base combined with several essential oils at a ratio of about 50:1 wt:wt ratio to about 50:3. However, other preferred embodiments include a ratio of about 100:1 to about 1:1, with preferred ratios at about 50:1 to about 50:2, including all ratios in between.

Beginning with a soap base, this element, a soap or shampoo like product is incorporated to the cosmetic brush soap to provide the cleaning element to the product. The term soap base is used in the industry to represent an unformulated soap or a partially formulated soap which may contain some additives but usually doesn't contain colorants, fragrants or specialty oils. The soap base can be made from a combination of oils and fats to give specific characteristics to the soap base. For example Goats Milk soap base means the soap contains Goats Milk.

In a preferred embodiment, the soap base as utilized in several examples below is a goat's milk soap suspension formula as sold by Life of Party, North Brunswick, N.J. 08902. This product includes the following ingredients: water, propylene glycol, sodium stearate, glycerin, sucrose, sodium laurate, sorbitiol, sodium laureth sulfate, sodium lauryl sulfate, Goats milk, sodium chloride, steric acid, lauric acid, silica, titanium dioxide, pentasodium pentetate, Tetrasodium etidronate, methylchloroisothiazoline, methylisothiazoline, magnesium chloride, magnesium nitrite. However, in further embodiments, other suitable soap bases may include: olive oil soap base, grape seed oil soap base, glycerin soap base, hemp oil soap base, coco butter soap base, soya soap base, yogurt soap base, shea butter soap base, oatmeal soap base, and mango butter soap base. Further embodiments may further comprise a combination of two or more soap bases.

Further soap bases components and additives may include palm oil, safflower oil, glycerin, sodium hydroxide, sorbitol, sorbitan oleate, and oat protein, and other suitable additives known to one of ordinary skill in the art. In certain embodiments, preservative components may be excluded from the soap base. Furthermore, the soap base may omit foaming agents such as sodium laureth sulfate and sodium lauryl sulfate.

In addition to the soap base, while cleansing the brush, it is important that the soap element does not also destroy the brush by damaging the hairs, damaging the glue and damaging the ferrule of the brush. These conditions are often exacerbated by failure to remove a cosmetic material on the hairs or bristles and wet or moist conditions. Accordingly, the ability of the brush to dry quickly after the soap is applied and then removed helps to maintain the life of the brush. Part of the reason for this is that a wet brush and any remaining cosmetic product serve to rot out the brush hairs, the glue, and or the ferrule holding the brush together. In certain instances, the ferrule can even begin to rust and lose hairs, thus necessitating replacement. A quick drying brush limits the damage to the glue holding together the hairs, and limits damage to the ferrule of the brush. Typically, using the cosmetic brush soaps described herein, the brush is dry in about eight hours or less, or preferably in 6 hours or less, for large brushes, and about 4 hours or less for medium brushes, and about 2 hours or less for small brushes, which is significantly quicker than other available products which often take between 24 and 48 hours to dry. Dry times of greater than 24 hours essentially prevent a user from a daily cleansing routine on a brush, which then allows a user to re-use the same brush the following day. Accordingly, users are unlikely to have a brush cleansing routine, or if they do, require additional brushes to allow for the cleaned brushes to dry.

It is also important to maintain the brush hairs by applying a conditioning product to the brush to maintain the hairs on the brush. Accordingly, a conditioning product is incorporated into the cleanser. In a preferred embodiment the conditioner is almond oil and/or coconut oil. These products can be combined in equal parts, or in unequal parts as appropriate. A preferred embodiment comprises about 0.18 to about 0.9 grams of almond oil to about 0.75 to about 1.5 grams of coconut oil, when combined with about 55 grams of goat's milk soap base. The total grams of each can be scaled appropriately by keeping the ratio consistent.

Other conditioners are suitable in further embodiments. For example, a non-exclusive list of suitable conditioners includes shea butter, olive oil, coco butter, coconut oil, almond oil, and argan oil. The conditioners may be utilized alone as the sole conditioning component, or can be utilized with two or more conditioners. Furthermore, some conditioners may further provide other cleaning or protective properties in some embodiments. The composition of the conditioner is preferably an oil having about 5% to about 50% weight saturated fatty acids, preferably about 10% to about 20% and about 1% to about 5% by weight unsaturated fatty acids, preferably about 1% to about 20% by weight. Preferably the saturated fat content contains several different C8-C20 saturated fats. Preferably there is at least one monounsaturated fatty acid between C8-C20 and at least one unsaturated fatty acid between C8-C20.

In certain preferred embodiments, there are at least 5 different saturated or unsaturated fatty acids in a conditioner, including: Caprylic, Decanoic, Lauric, Myristic, Palmitic, and Oleic fatty acids. In certain preferred embodiments, the fatty acid content of the conditioner comprises:

Caprylic saturated C8-9%
Decanoic saturated C10-10%
Lauric saturated C12-52%
Myristic saturated C14-19%
Palmitic saturated C16-11%
Oleic monounsaturated C18:1-8%

In a further embodiment, the fatty acid content of a conditioner comprises the following fatty acids: palmitic (C16:0), oleic (C18:1), linoleic (C18:2), and alpha-linolenic (C18:3) acid, respectively, at a weight percentage of about 5% to 7%, 50% to 75%, 10% to 40%, and 0.01% to 1.0%; of the total lipids in the composition. The two above fatty acid compositions can then be combined at a weight ratio of between about 12:1, resulting in several different fatty acids combining as the conditioner.

A fragrance is suitably added to the cosmetic brush cleaner to provide a pleasant smell to the cleanser and ultimately to the cleaned brush. Typically, an oil such as jasmine oil or rose oil can be used as a suitable fragrance. However, there are numerous other scents and oils that can otherwise be utilized as is known to one of ordinary skill in the art.

Finally, an antiseptic additive is added to the cosmetic brush cleanser to provide for cleansing at a micro level, as compared to the macro cleansing of the soap base. The antiseptic additive seeks to reduce the prevalence of microbes such as bacteria, spores, viruses, funguses and the like. While the goal of such additives is to eliminate all such microbes, in practice that is nearly impossible, absent sterilization, and so the antiseptic additive destroys some but not all microbes on the brush. In a preferred embodiment, Lavender oil and coconut oil are used alone or in combination as an antiseptic additive.

In further embodiments, other of several antiseptic additives may be utilized including oils, extracts, or materials derived from: bayberry, birch leaf, lavender, mint, sandalwood, tea tree, witch hazel, ylang-ylang, neroli, lemongrass, lemon and other citrus, geranium, clove, peppermint, coconut, and calendula. The antiseptic additive may be one of these or related material, or a combination of two or more of these antiseptic additives.

The cosmetic brush cleaner, through the use of organic essential oils, and a solid soap base provides a product that is a self-sustaining anti-microbial, anti-fungal, and anti-bacterial cleansing formula. It is preferably manufactured and then placed into a glass, plastic, or metal container for use.

Because of the nature of the preferred embodiments, the cosmetic brush cleanser has a faster drying time as compared to other brush cleansers on the market, which is advantageous for quickly washing the brushes and then being able to use the brushes quickly without manually drying the brushes, or having to touch the delicate brush fibers with a cloth or other drying agent, or heat.

Furthermore, the cosmetic brush cleanser provides a superior cleaning ability as compared to several commercially available cleansers. Because the consumer uses less cleanser to clean their instruments, the consumer can reduce the cleanser necessary thus saving time, but also provides a green benefit or reducing the amount of cleanser used in the products. Furthermore, the lower amount of cleanser used prolongs and extends the life of brushes cleaned with a product defined by the embodiments.

Finally, the life of the brushes cleaned with the product are further prolonged by the use of a conditioner incorporated into the cosmetic brush cleanser. Accordingly, a consumer does not need to buy a separate cleanser and conditioner, when using embodiments as described herein. Furthermore, as the brushes are being conditioned while being cleansed, the damage to the brush is reduced, prolonging the life of the brush.

In a preferred embodiment, a cosmetic brush cleanser comprises a soap base of goat's milk, almond oil, jasmine oil, coconut oil, and lavender oil. The soap base is melted and the oils are added into the soap base before the mixture is solidified for use. To cleanse a brush, a method exists where the user then takes a small portion of the cosmetic brush cleanser and applies it to the brush (or rubs the brush on the cleanser), before the brush is rinsed clean. For example, using a cosmetic brush cleanser in one of the examples below, add a small amount of warm water to the solid brush cleanser, dip the brush hairs into the warm water and agitate the brush hairs to contact the water and the brush cleanser and begin removing the cosmetic product and cleaning the brush. Once the cosmetic product has been removed from the brush hairs, rinse the brush with clean water and lay flat to dry. The brush may be gently compressed in a towel or squeezed to remove excess water before it is laid flat to dry.

After the brush is cleaned, it takes about four to eight hours for an average medium to large brush to dry. A brush must be dried before it can again be used. There is no industry standard or definition for small, medium or large brushes, however, examples of the type of brushes that fall into each classification include several examples listed below.

Examples of small brushes are eyeliner brushes, eye shadow brush, lip brush, brow brush, concealer brush, eye shadow brush, eye smudger brush, eye contour brush and eye shadow blending brush.

Examples of medium brushes are blush brush, bronzer brush, foundation brush and face blender brush.

Examples of larger brushes are powder brush, face brush and touchup brush.

The drying time for a brush is more dependent upon the size of the brush rather than if the brush has its bristles highly condensed or not. Highly condensed brushes have a lot of bristles typically in a round configuration. Non-highly condensed brushes have the bristles in a flat line typically about 1-2 mm in thickness; these brushes often dry in about two hours using the cleaners described herein. To assist in drying the brush, a cloth or other material can be used to remove excess water from the brush, and/or the brush hairs can be gently squeezed. When comparing the dry time using the brush cleansers described herein to other available cleansers, the drying time is significantly less.

The fast dry time provides several benefits over competitor products. For examples, by reducing the moist conditions on the brush hairs, glue, and ferrule, it minimizes the rotting of the glue, the hairs, and the ferrule due to the moist conditions. This helps to prevent the hairs from falling out of the brush. Furthermore, by limiting the time that the brush is moist, the conditions for bacterial growth are limited. Finally, since the brushes dry in about eight hours or less, the brushes can be used every day without worry of placing a moist brush into expensive cosmetic products. Accordingly, an individual user would not need to have multiple sets of brushes because of the faster dry time as compared to competitor products.

The examples provided herein are merely examples of some of the embodiments described in this disclosure. The examples are non-limiting, and each of the examples can be combined with other teachings and components as described in the disclosure.

EXAMPLES

Brush Cleaning Procedure for testing the below cosmetic brush cleaner examples.

To prepare a brush for cleaning, apply 1 mL of liquid foundation makeup (TIGI satin liquid foundation, TIGI, Lewisville, Tex., USA) to the brush (Round Blending Brush, Qosmedix, 95-Q Executive Dr. Edgewood, N.Y. 11717). Work the makeup into the brush by brushing back and forth on a glass plate to simulate applying the makeup and working the makeup into the bristles of the brush until no excess makeup is on the outside of the brush. Allow the brush to stand at room temperature for at least 5 minutes before cleaning.

To clean the brush, cover the brush cleaner with a small layer of warm water in the container of brush cleaner. Make sure there is no makeup on the cleaner. If there is makeup on the cleaner, rinse the brush cleaner with warm water until the makeup is removed. Swirl a dirty brush 15 times in the wet brush cleaner and work up a lather. Next swirl the brush 10 times in the palm of a hand. Gently squeeze the excess cleaner and makeup out the brush. Repeat squeezing the excess cleaner and makeup out of the brush for a total of two times.

Swirl the brush 10 times in the palm of a hand while warm running water is gently falling on the brush. Squeeze the excess cleaner and makeup out the brush. Repeat swirling the brush 10 times in the palm of a hand while warm running water is falling on the brush and gently squeezing the excess cleaner and makeup out of the brush. For the third time, swirl the brush 10 times in the palm of a hand while warm running water is falling on the brush and gently squeezing the excess cleaner and makeup out of the brush. This is considered one brush cleaning cycle.

Carefully evaluate the liquid coming out of the brush during the last squeeze to see if makeup is still coming out of the brush. If makeup is still coming out of the brush, repeat the cleaning cycling starting with swirling the brush in the brush cleaner that has a small layer of warm water in the container.

After no more makeup is observed coming out of the brush, repeat swirling the brush 10 times in the palm of a hand while warm running water is falling on the brush and gently squeezing the excess cleaner and makeup out of the brush 3 more times to ensure that all the cleaner is rinsed out of the brush. Gently wipe the excess water off the brush with a dry towel and gently shape the bristles of the brush. Allow the brush to dry at room temperature. Measure the time it takes for the bristles to dry.

The following brush cleansers were tested in several examples listed below:

Commercial Brush Cleaner A

Goat Milk Brush Shampoo, London Brush Company, 934 Sheldon Street El Segundo, Calif. 90425—USA—Contents: Goat Milk, Palm oil, Coconut Oil, Olive Oil, Water, Tea Tree Extract.

Commercial Brush Cleaner B

Clean Brush Shampoo, Love Make Up, 4 Frenchs Yard, Ware, Hertfordshire, SG12 9HP, UK.—Contents: Glycerin, palm oil, coconut oil, goat's milk powder, titanium dioxide, tea tree oil, and lemon essential oil.

Commercial Brush Cleaner C

Karen Zander Jasmine Sponge & Brush Soap, Enkore Makeup LLC, Bordentown N.J.—Contents: Sorbitol, propylene glycol, water, sodium stearate, sodium laureth sulfate, sodium myristate, sodium larate, trietanolamine, glycerin, titanium dioxide, passionfruit seed oil, argan oil, avocado oil, jojoba oil, apricot kernel oil, loofah.

Sample 1

Soap Base (Goat's Milk) 55.8 grams
Almond Oil 0.9 grams
Jasmine Oil 0.51 grams
Coconut Oil 0.75 grams
Lavender Oil 0.005 grams Melt the sold goat's milk soap base into a pot. Once the goats milk soap base is melted, add to the soap base the four oils. Stir the mixture until the ingredients are fully incorporated. Pour the warm mixture into a 120 ml can. Allow the mixture to solidify before it is ready for use.

Sample 2

Soap Base (Goat's Milk) 55.8 grams
Almond Oil 0.9 grams
Jasmine Oil 0.51 grams
Lavender Oil 0.005 grams Melt the sold goat's milk soap base into a pot. Once the goats milk soap base is melted, add to the soap base the four oils. Stir the mixture until the ingredients are fully incorporated. Pour the warm mixture into a 120 ml can. Allow the mixture to solidify before it is ready for use.

Sample 3

Soap Base (Goat's Milk) 55.8 grams
Almond Oil 0.18 grams
Jasmine Oil 1.02 grams
Coconut Oil 1.50 grams
Lavender Oil 0.01 grams Melt the sold goat's milk soap base into a pot. Once the goats milk soap base is melted, add to the soap base the four oils. Stir the mixture until the ingredients are fully incorporated. Pour the warm mixture into a 120 ml can. Allow the mixture to solidify before it is ready for use.

Sample 4

Soap Base (Goat's Milk) 55.8 grams
Almond Oil 1.1 grams
Jasmine Oil 2.04 grams
Coconut Oil 2.25 grams
Lavender Oil 0.02 grams Melt the sold goat's milk soap base into a pot. Once the goats milk soap base is melted, add to the soap base the four oils. Stir the mixture until the ingredients are fully incorporated. Pour the warm mixture into a 120 ml can. Allow the mixture to solidify before it is ready for use.

Sample 5

Soap Base (Goat's Milk) 55.8 grams
Almond Oil 0.045 grams
Jasmine Oil 0.26 grams
Coconut Oil 0.37 grams
Lavender Oil 0.003 grams Melt the sold goat's milk soap base into a pot. Once the goats milk soap base is melted, add to the soap base the four oils. Stir the mixture until the ingredients are fully incorporated. Pour the warm mixture into a 120 ml can. Allow the mixture to solidify before it is ready for use.

Sample 1 has 3.88% oil,
Sample 2 has 2.54% oil,
Sample 3 has 4.86% oil,
Sample 4 has 9.70% oil
Sample 5 has 1.22% oil.

Example 1

The 3 commercial brush cleaners (C-1-C-3) and Samples 1 to 5 (E-1-E-5) were evaluated to determine the effectiveness of their ability to clean cosmetic brushes using the brush cleaning procedure. Table 1 shows that the formulations of samples 1, 2 and 3 average fewer cleaning cycles than the commercial brush cleaners.

TABLE 1

| | Cleaner: | | | | | | | |
|---|---|---|---|---|---|---|---|---|
| | C-1 | C-2 | C-3 | E-1 | E-2 | E-3 | E-4 | E-5 |
| Cleaning cycles (typical result): | 5 | 4 | 10 | 2 | 4 | 3 | 4 | 5 |
| Cleaning cycles (Ave of 5 series) | 4 | 3 | 7 | 2 | 2 | 2 | 3 | 4 |

Example 2

Brush dry time was measured by taking the initial weight of the brush after cleaning and then measuring the weight of the brush approximately every hour until all the brushes were dry. Table 2 shows the results for a typical drying after cleaning and the average dry time of 5 series of cleanings. The results show that the Samples 1 and 2 dry significantly faster than the commercial brush cleaners. Sample 4 shows that if the oil level is increased too much that there is a negative impact on drying time. Sample 5 shows that if the oil level is decreased too much that there is a negative impact on drying time.

TABLE 2

| | Cleaner: | | | | | | | |
|---|---|---|---|---|---|---|---|---|
| | C-1 | C-2 | C-3 | E-1 | E-2 | E-3 | E-4 | E-5 |
| Dry Time—typical result (hrs): | 6 | 7 | 13 | 5 | 6 | 6 | 11 | 11 |
| Dry Time—Ave of 5 series (hrs): | 10 | 8 | 12 | 5 | 7 | 8 | 11 | 12 |

Example 3

Brush cleaner utilization is an important consideration for the user of brush cleaners. The more efficient the brush cleaner, the more brushes the consumer can clean with a given weight of brush cleaner. Brush cleaners with higher utilization rates provide less waste, greater convenience and higher value to the user. Utilization was measured by measuring the amount of brush cleaner used after 5 series of brush cleaning Table 3 shows that Samples 1, 2, 3 and 4 have much better brush cleaner utilization than the commercial cleaners.

TABLE 3

| | Cleaner: | | | | | | | |
|---|---|---|---|---|---|---|---|---|
| | C-1 | C-2 | C-3 | E-1 | E-2 | E-3 | E-4 | E-5 |
| Weight of brush cleaner used after 5 series of brush cleaning (grams): | 24.5 | 6.7 | 16.9 | 2 | 1.7 | 2.5 | 1.4 | 9.4 |

Based on this data formulations comprising a goats milk soap base and the oils having a total oil content of between about 2.0% to 5.0% based on the total weight of soap base and oil is preferred. Based on the spectrum between Sample 3 and Sample 4, it is further provided that a total oil content of less than about 8% is preferred, wherein the total oil content is between about 2.47% and about 8%.

A further sample product (E-6) utilized olive oil soap base:

Soap Base (Olive Oil) 111.6 grams
Almond Oil 0.18 grams
Jasmine Oil 1.02 grams
Coconut Oil 1.50 grams
Lavender Oil 0.01 grams Melt 111.6 grams of a solid olive oil soap base into a pot. Once the olive oil soap base is melted, add to the soap base the four additional oils. Stir the mixture until the ingredients is fully incorporated. Pour the warm mixture into a 120 ml can. Allow the mixture to solidify before it is ready for use.

Although the present invention has been described in considerable detail, those skilled in the art will appreciate that numerous changes and modifications may be made to the embodiments and preferred embodiments of the invention and that such changes and modifications may be made without departing from the spirit of the invention. It is therefore intended that the appended claims cover all equivalent variations as fall within the scope of the invention.

What is claimed is:

1. A cosmetic brush cleanser comprising a solid goat's milk soap base, almond oil, jasmine oil, and lavender, wherein said soap base is combined with said mixture of essential oils, said oils comprising a percentage of about 2.5% to about 9.7% of the total weight of the cosmetic brush cleaner.

2. The cosmetic brush cleanser of claim 1 further comprising coconut oil.

3. The cosmetic brush cleanser of claim 1 wherein the amount of soap base to essential oil is about 55:1.4 to about 55:5.4.

4. The cosmetic brush cleanser of claim 1 wherein the amount of soap base to essential oil is about 55:1.4 to about 55:2.7.

5. The cosmetic brush cleanser of claim 1 wherein the amount of soap base to essential oil is about 55:1 to about 55:2.2.

6. The cosmetic brush cleanser of claim 2 wherein the essential oils comprise about 0.3% to about 1.6% of almond oil, about 0.4% to about 3% of jasmine oil, about 0.6% to about 4% of coconut oil, and about 0.009% to about 0.03% of lavender oil.

7. A process for making a cosmetic brush cleanser comprising melting a sufficient quantity of a solid goat's milk soap base, and thereafter adding to the melted soap base a sufficient quantity of a mixture of essential oils comprising an almond oil, jasmine oil, and lavender oil, combining said essential oils and said solid goat's milk soap base, wherein said essential oils comprise about 2.5% to about 9.7% of the total weight of the cosmetic brush cleaner; stirring the essential oils into the melted soap base; and pouring the resulting composition into a receptacle and allowing the resulting composition to solidify.

8. The process of claim 7 wherein the mixture of essential oils further comprises coconut oil.

9. The Process of claim 8, wherein the mixture of essential oils comprises about 2.5% to about 4.6% of the composition.

10. The process of claim 8, wherein the mixture of essential oils comprises about 0.3% to about 1.6% of almond oil, about 0.4% to about 3% of jasmine oil, about 0.6% to about 4% of coconut oil, and about 0.009% to about 0.03% of lavender oil.

11. A cosmetic brush cleaner comprising a goat's milk soap base and a combination of at least four oils, wherein the goat's milk soap base comprises about 95 to about 97.5% and the combination of at least four oils comprises between about 2.5% to about 5% of the total weight of the cosmetic brush cleaner.

12. The cosmetic brush cleaner of claim 11 wherein the at least four oils comprise almond oil, jasmine oil, coconut oil, and lavender oil.

13. The cosmetic brush cleaner of claim 12 comprising about 97.5% goat's milk soap base and about 2.5% of oils.

14. The cosmetic brush cleaner of claim 12 comprising about 0.3% to about 1.6% of almond oil, about 0.4% to about 3% of jasmine oil, about 0.6% to about 4% of coconut oil, and about 0.009% to about 0.03% of lavender oil.

15. The cosmetic brush cleaner of claim 12 comprising a ratio of about 55 grams of solid goat's milk soap base to about 0.18 to about 0.9 grams of almond oil, about 0.51 to about 1.02 grams of jasmine oil, about 0.75 to about 1.50 grams of coconut oil and about 0.005 to about 0.01 grams of lavender oil.

16. The cosmetic brush cleaner of claim 12 wherein about 0.5 grams of cosmetic brush cleaner are needed to clean a brush.

17. The cosmetic brush cleaner of claim 12 wherein a brush dries in under 8 hours after cleaning.

18. The cosmetic brush cleaner of claim 12, wherein a brush dries in about 6 hours or less after cleaning, and wherein about less than 0.5 grams of cleanser are required to clean a brush.

* * * * *